United States Patent [19]

Benbow

[11] Patent Number: 4,846,388

[45] Date of Patent: Jul. 11, 1989

[54] YARN DISPENSING APPARATUS

[76] Inventor: Christopher B. Benbow, 541 Crouch St., Oceanside, Calif. 92054

[21] Appl. No.: 735,131

[22] Filed: May 17, 1985

[51] Int. Cl.[4] ..... B65H 20/02

[52] U.S. Cl. ..... 226/134; 226/153; 226/187

[58] Field of Search ..... 226/152, 153, 186, 187, 226/134; 242/127, 54 R, 129; 66/132 R, 132 T, 125 R; 57/90, 91; 206/508, 45.19

[56] References Cited

U.S. PATENT DOCUMENTS

| | | | |
|---|---|---|---|
| 2,827,247 | 3/1958 | Kraemer | 242/127 |
| 2,926,779 | 3/1960 | Jepson | 206/45.19 |
| 2,952,393 | 9/1960 | Newton | 66/132 X |
| 3,058,641 | 10/1962 | Peterson | 226/153 X |
| 3,093,284 | 6/1963 | Mullin | 226/186 X |
| 3,145,870 | 8/1964 | Lockwood | 206/508 X |
| 3,184,820 | 5/1965 | Kanbar | 66/132 X |
| 3,216,222 | 11/1965 | Schmidt | 66/132 |
| 3,823,894 | 7/1974 | Fredrick et al. | 242/129 X |
| 3,901,426 | 8/1975 | Zatopek et al. | 226/134 |
| 4,004,745 | 1/1977 | Booth | 242/127 X |
| 4,120,239 | 10/1978 | Pasic et al. | 226/152 X |

FOREIGN PATENT DOCUMENTS

| | | | |
|---|---|---|---|
| 527616 | 7/1956 | Canada | 226/186 |
| 104942 | 7/1942 | Sweden | 226/153 |
| 464440 | 4/1937 | United Kingdom | 226/153 |
| 1434021 | 4/1976 | United Kingdom | 66/132 R |

*Primary Examiner*—John M. Jillions
*Attorney, Agent, or Firm*—Duane C. Bowen

[57] ABSTRACT

A yarn dispenser having upper and lower rollers feeding yarn from a skein. The upper roller is pivoted to the side for insertion and removal of yarn. The upper roller has a part of its central circumference recessed so as to free yarn one time in each rotation of the upper roller, to thereby prevent balling of the yarn. A miniature, 1.5 V battery powered motor powers the rollers via an O-ring belt drive. A foot controlled switch is used in the electrical circuit. The yarn dispenser can be mounted in a briefcase sized receptacle by snap fasteners or may be removed, in which case the dispenser can be supported above a supporting surface on a removable cover on which the base rests.

12 Claims, 2 Drawing Sheets

Fig. 5
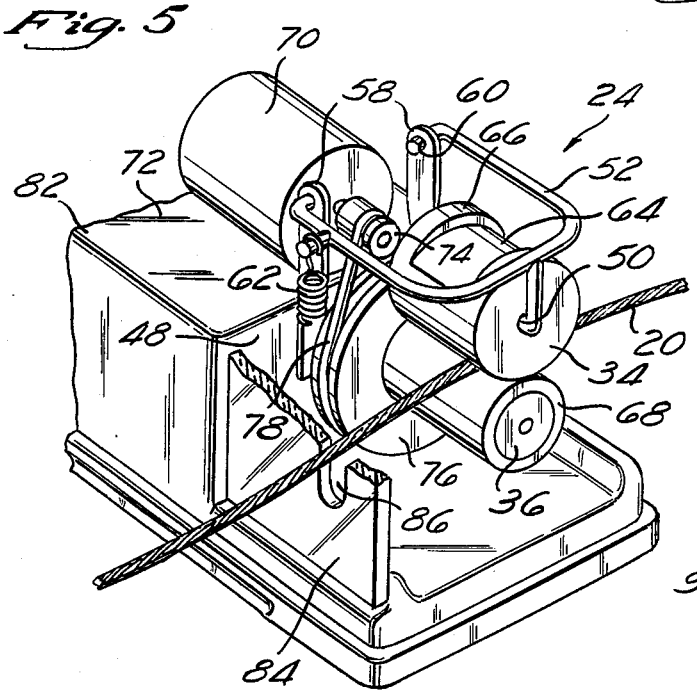
Fig. 8
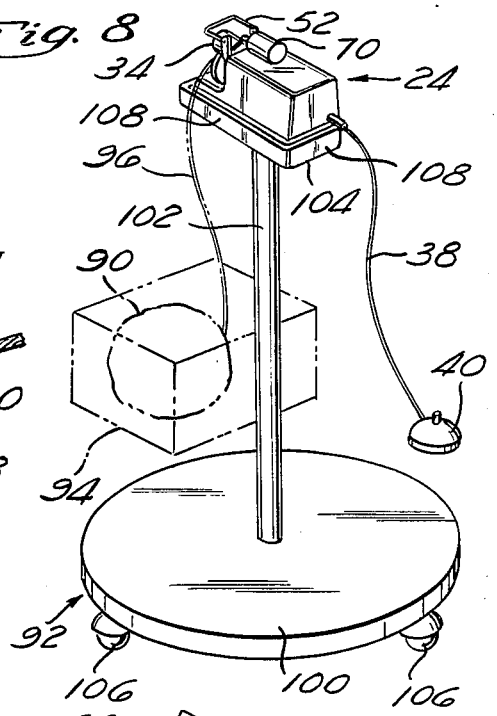
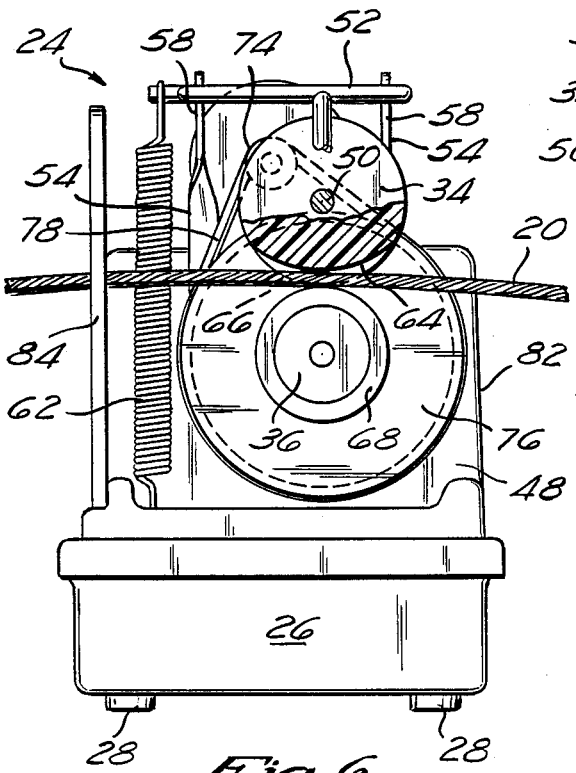
Fig. 6
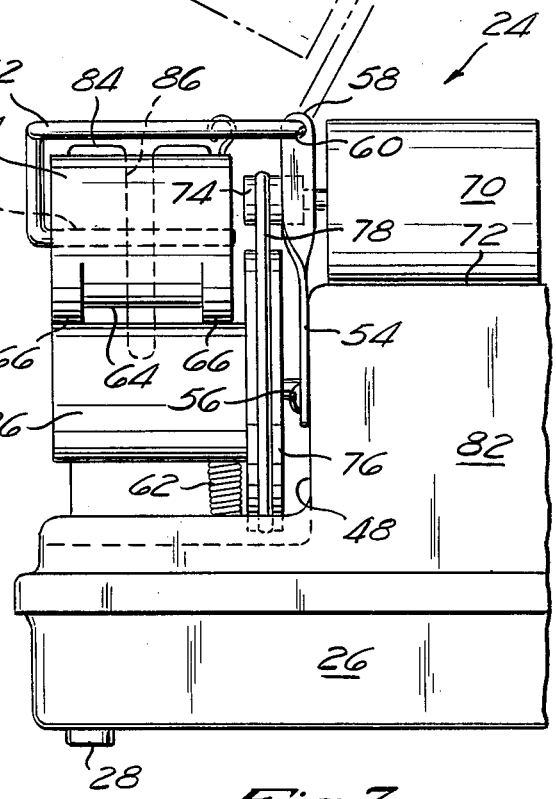
Fig. 7

YARN DISPENSING APPARATUS

BRIEF SUMMARY OF THE INVENTION, BACKGROUND AND OBJECTIVES

My invention relates to a yarn dispenser feeding yarn from a skein.

In manual knitting of yarn, it would be desirable to feed yarn from a skein by electrical power, under foot pedal control, and it is an objective of my invention to provide yarn dispensing apparatus designed accordingly.

Yarn in a skein is twisted with respect to rectilinear withdrawal of yarn. If yarn is fed from a skein by a pair of plain rollers pressing on opposite sides, the twist of the yarn tends to knot up, because the rollers tend to straighten the yarn rather than to accommodate the twist of the yarn. It is an objective of my invention to provide for relief in roller feed of yarn so that the yarn can be periodically released to accommodate yarn twisting.

Further objectives of my invention include to provide a handy carrying case, for one or more yarn skeins, integrated with the yarn feeding mechanism facilitating quick and easy skein receipt, removal or interchange; and to devise a low weight, low price, durable, low maintenance, easily operated assembly.

My invention will be best understood, together with additional advantages and objectives thereof, when read with reference to the drawings.

DRAWINGS

FIG. 5 is a partial perspective view of portions of the assembly.

FIG. 6 is an enlarged end view of the assembly.

FIG. 7 is a partial side view of the assembly. A second position of the upper roller is indicated in dashed lines.

FIG. 8 is a perspective view of a stand used to support the yarn dispenser above floor level. A box, containing a ball of yarn, is indicated in dashed lines.

SPECIFIC DESCRIPTION

I will first describe the yarn dispensing apparatus when installed in a case 10 and then I will later describe the yarn dispensing apparatus used apart from case 10.

Figure 1:
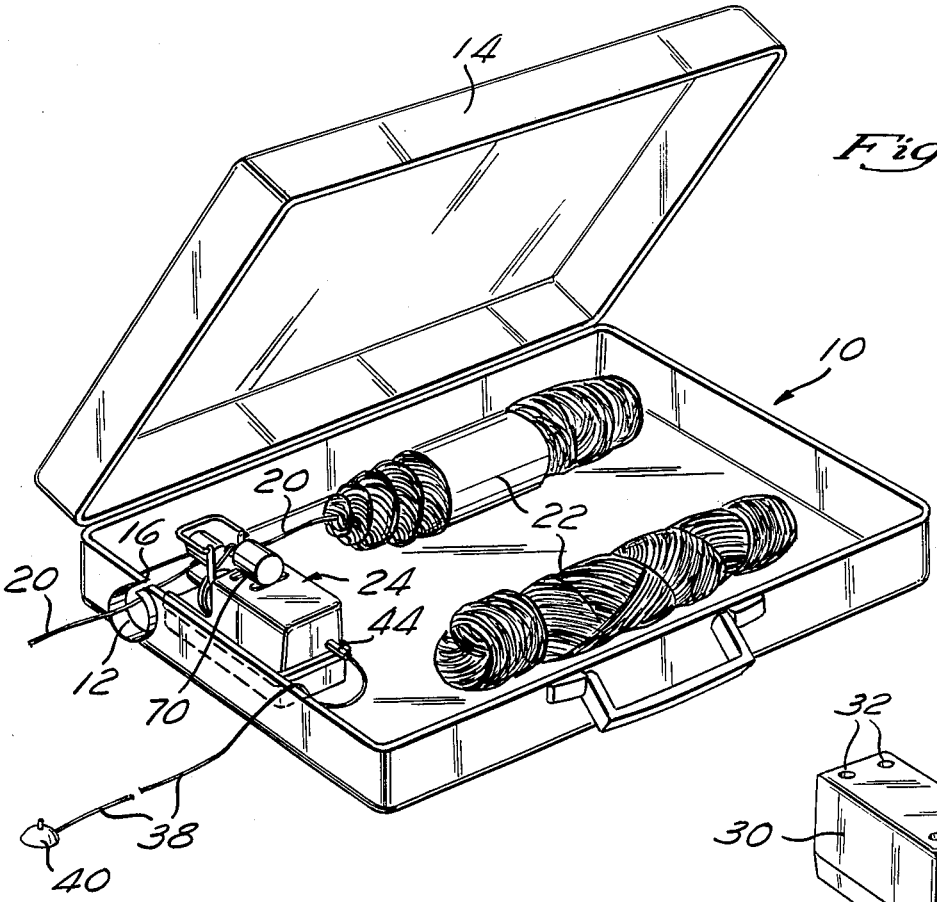
FIG. 1 is a perspective view of yarn dispensing apparatus housed in a case, forming a specific embodiment of my invention.

Case 10 can have a number of shapes, proportions and sizes but a right-rectangular form rather like some brief cases, opening on hinges and secured with a latch (not shown), is illustrated in FIG. 1. An opening 12 permits feeding of yarn to the space outside of the case even when the lid 14, is lowered. Opening 12 has a slot 16, open to the edge of the lower case section, for easy insertion and removal of yarn 20 from skein 22. Case 10 can contain extra skeins of the same or different colors and can contain other knitting supplies. The invention will be described as being used to dispense yarn for knitting, for convenience, as most uses will be for knitting, but the apparatus also can be used in crocheting.

The yarn dispenser 24 can be used outside case 10, so it is secured in place in case 10 by four snap fasteners. The base 26 of dispenser 24 can have four male snap fastener parts 28 located in the corners of its lower surface and the inner surface of case 10 can have four coacting female snap fastener parts (not shown) which locates dispenser 24 adjacent to opening 12.

Figure 2:
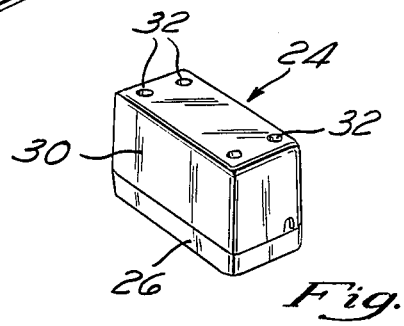
FIG. 2 is a perspective view of the yarn dispensing apparatus separated from the case and with its cover in place.
Figure 4:
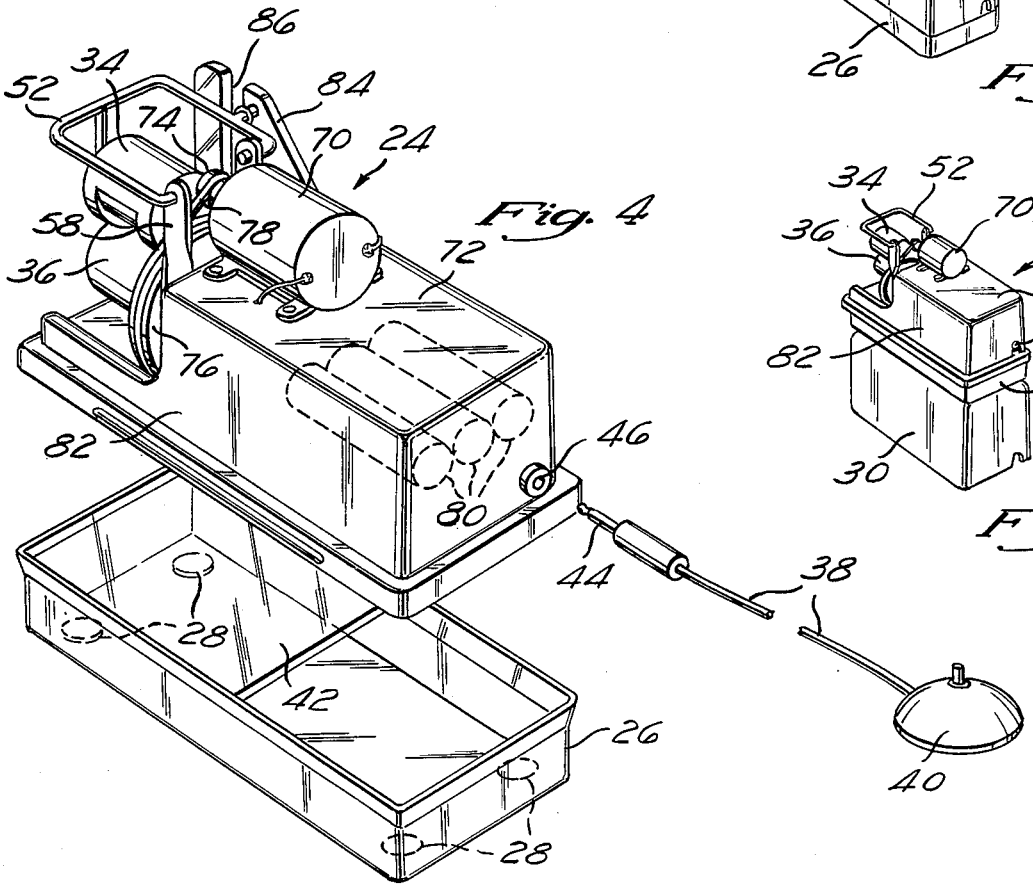
FIG. 4 is an enlarged perspective view of the yarn dispensing instrumentalities with the base shown in removed position.
Figure 3:
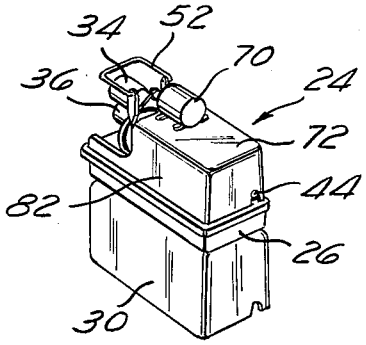
FIG. 3 is like FIG. 2 but shows the cover removed and being used to support the yarn dispensing instrumentalities a distance above a supporting surface.

Cover 30 fits over dispenser 24 when the dispenser is not in use, as shown in FIG. 2. It has four depressions 32 in its upper surface matched to snap fasteners 28 in location, so that the parts can be changed with cover 30 below and dispenser 24 mounted thereon, with snap fasteners 28 located in depressions 32. In that case, cover 30 would rest on a supporting surface and the yarn dispensing rollers 34, 36 would be supported high enough above the supporting surface for there to be sufficient space to receive yarn dispensed from rollers 34, 36. In that way, yarn piling up, in a sufficient quantity for knitting, between dispensing cycles, would be free from rollers 34, 36.

Base 26 can be unsnapped from the bottom of dispenser for stowage of a detachable control cord 38 and a foot-controlled switch 40. A partial partition 42 secures cord 38 and 40 in stowed position. Switch 40 is preferably of the type that is normally spring pressed to open position and switch 40 is held depressed by the foot during yarn dispensing. Cord 38 has a conventional plug 44 and dispenser 24 has a coventional receptacle 46.

Yarn dispenser 24 supports feed rollers 34, 36 preferably in superposed position, so that yarn feeds therebetween in a generally horizontal travel. Although some other direction of yarn feed, such as vertical feed, would be possible, the type of mechanism shown is believed to be simpler with horizontal feed. In the dispensing position of rollers 34, 36, the axes of rotation are generally horizontal and the rollers are supported in cantilevered manners.

Lower roller 36 is supported from an upright wall 48. Upper roller 34 is supported from a shaft 50 cantilevered from a yoke 52 pivotally connected to a pair of arms 54 secured by fasteners 56 such as rivets to upright wall 48. The upper ends 58 of arms 54 are twisted and have openings 60 receiving the ends of yoke 52 to pivotally support yoke 52, so that shaft 50 and upper roller 34 thereon are pivotally supported about an axis extending at right angles to the axis of lower roller 36 (when viewed in plan view). Upper roller 34, thus, has a yarn dispensing position abutted to lower roller 36 and a removed yarn releasing position in which yarn 20 can be positioned between rollers 34, 36 or removed from between rollers 34, 36. A tension spring 62 is attached to yoke 52 to press upper roller 34 to lower roller 36 when the upper roller is in yarn dispensing position.

I have discovered a primary problem, in dispensing yarn by running the yarn between a pair of rollers, to be the tendency of the yarn to ball. This is because the yarn is twisted and the rollers, pressing on opposite sides, tend to straighten the yarn. I have discovered the problem of balling of yarn can be avoided by periodically relieving the yarn from roller pressure. This works well if the periodic release is timed to the rotation of rollers 34, 36. More specifically, the effectiveness of release of yarn, to prevent balling, may relate to factors such as the diameter of upper roller 34, the circumferential distance of recess 64 in upper roller 34 which relieves yarn 20 from roller pressure, and the speed of feed of yarn 20. In a prototype, upper roller 34 was about $\frac{7}{8}$ inch in diameter, the circumferential distance of recess 64 was about 144°, and the speed of feed of yarn 20 was about 2 feet per second. Recess 64 would be ineffective unless some provision is made to prevent lower roller 36 from entering recess 64. In essence, the axes of rollers 34, 36 should not move toward each other when recess 64 faces lower roller 36. The way I have prevented this is by the profile of upper roller 34 in the area of recess 64. As shown in FIGS. 6 and 7, a cross-section intersecting the axis of upper roller 34, through recess 64, has end areas 66 of normal radiuses and a central area, the area of recess 64, of reduced radiuses. The areas 66 of normal radiuses, bearing on lower roller 36, prevents lower roller 36 from entering recess 64. Recess 64 could be in lower roller 36 rather than upper roller 34, and lower roller 36 could be pivotally supported by a yoke or otherwise for yarn insertion and release.

Upper driven roller 34 may be made all or partly from a rigid plastic whereas lower driving roller 36 can be made from a resilient material or may have a sleeve 68 of softer material. If black rubber were used for sleeve 68, yarn 20 could get marked if the rollers spun, so a different material, such as polyurethane, would be better for sleeve 68. The resilient material is better used on the driving roller and the rigid material is better used on the roller having recess 64.

An electric motor 70 is mounted on an upper wall 72 that extends horizontally from upright wall 48. Motor 70 has a small sheave 74 and a large sheave 76 is secured to lower roller 36. An O-ring belt 78 connects sheaves 74, 76.

A low-priced motor 70 can be used, such as a miniature motor used for hobbies. In prototypes, miniature D.C. motors were used with oiless bearings and barium ferrite magnets, with a voltage range of 1.5–3.0, and an rpm at no load of around 10,000, more or less. Current is from three 1.5 volt, size AA batteries 80. The total of 4.5 volts from three 1.5 volt batteries would overload the motors cited, for extended continuous use, but yarn 20 is only dispensed in short bursts. In prototypes, three quality 1.5 bolt batteries had very satisfactory lives, although a rechargeable battery system could be used or a circuit could be designed using household AC 110 volt electricity. The circuitry for motor 70, batteries 80, control cord 38 and foot-controlled switch 40 will be obvious. In prototype construction, a vacuum formed housing shell was used, formed in three pieces: a main housing shell including upright wall 48 and upper wall 72; the map-on base 26; and the snap-on cover 30. Batteries 80 are housed and suitably supported on the underside of main housing shell 82. A shield 84, at the yarn entrance side of rollers 34, 36, is mounted on shell 82. Shield 84 has an upwardly open slot 86, so that shield 84 prevents catching of skein 22 between rollers 34, 36. Yarn is easily inserted in and removed from the yarn dispenser through slot 86 and by pivoting of upper roller 34 to the yarn receiving position shown in dashed lines in FIG. 7.

A special problem is presented by yarn that is wound circumferentially as a ball 90, rather than feeding from the center of an elongated skein which is more common. The ball 90 needs to roll about or tumble to unwind. FIG. 8 shows a stand 92 that is used to support yarn dispenser 24 a foot or more above floor level. A preferred height would be about sixteen inches. Ball 90 is disposed in a container 94 and yarn 96 therefrom is pulled from ball 90 generally vertically by dispenser 24. Ball 90 can roll about in container 94 during yarn feed to rollers 34, 36 of dispenser 24.

Stand 92 has a circular base or body 100, an upright 102 of cylindrical outline, a rest 104 supporting dispenser 24, and casters 106 supporting base 100. Rest 104 has rectangular lips 108 fitting the base 26 of dispenser 24.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. Means to feed yarn from a skein during knitting periodically operated by a person hand knitting when more yarn is needed for knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers selectively by the knitter for yarn exchange, (b) spring means acting on said rollers to press on said yarn to feed said yarn when said upper roller is in said yarn dispensing position and said rollers are rotated, and means operative to periodically relieve said yarn from roller pressure in periods timed to each rotation of one of said rollers thereby relieving said yarn from twisting to prevent balling, (c) an electric motor connected to one of said rollers to rotate the same and a manually controlled switch controlling operation of said motor whenever the person hand knitting needs a supply of yarn unwound from said skein, and (d) said means operative to periodically relieve said yarn being a centrally recessed portion along the circumference of one of said rollers spaced from its ends, whereby once each revolution of said one roller said recessed portion releases said yarn during feeding of said yarn.

2. The subject matter of claim 1 in which said one roller has a cross-section intersecting the axis thereof and through said recessed portion in the form of end areas of normal radiuses and a central area of reduced radius, said support means supporting said upper roller including said spring means pressing said upper roller to said lower roller in said yarn dispensing position of said upper roller and said end areas of normal radiuses preventing the other roller from entering said recessed portion under the urging of said spring means.

3. Means to feed yarn from a skein during knitting periodically operated by a person hand knitting when more yarn is needed for knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be position between said rollers or removed from between said rollers selectively by the knitter for yarn exchange, (b) spring means acting on said rollers to press on said yarn to feed said yarn when said upper roller is in said yarn dispensing position and said rollers are rotated, and means operative to periodically relieve said yarn from roller pressure in periods of timed to each rotation of one of said rollers thereby relieving said yarn from twisting to prevent balling, (c) an electric motor connected to one of said rollers to rotate the same and a manually controlled switch controlling operation of said motor whenever the person hand knitting needs a supply of yarn unwound from said skein, (d) said means operative to periodically relieve said yarn being a recessed portion along the circumference of one of said rollers, whereby once each revolution of said one roller said recessed portion releases said yarn during feeding of said yarn, (e) said one roller having a cross-section intersecting the axis thereof and through said recessed portion in the form of end areas of normal radiuses and a central area of reduced radius, said support means supporting said upper roller including said spring means pressing said upper roller to said lower roller in said yarn dispensing position of said upper roller and said end areas of normal radiuses preventing the other roller from entering said recessed portion under the urging of said spring means, and (f) said support means supporting said upper roller for pivotal movement about an axis extending at right angles to said axis of said lower roller when viewed in plan view, said dispenser including a housing shell with an upright wall and a shaft cantilevered from said wall on which said lower roller is mounted.

4. The subject matter of claim 3 in which support means includes a yoke pivotally mounted on said shell to pivot about said axis extending at right angles to said axis of said lower roller and said upper roller being mounted on a shaft cantilivered from the center of said yoke and said spring means acting on said yoke.

5. The subject matter of claim 3 in which said shell includes an upper wall extending horizontally from said upright wall, said electric motor being mounted on said upper wall, and a small sheave on said motor and a large sheave on said lower roller and an O-ring connecting said sheaves.

6. Means to feed yarn from a skein during knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers, (b) said rollers being disposed to press on said yarn to feed said yarn when said upper roller is in said yarn dispensing position and said rollers are rotated, and means operative to periodically relieve said yarn from roller pressure timed to the rotation of said rollers thereby relieving said yarn from twisting to prevent balling, (c) said dispenser including a housing shell having an upright wall and a shaft cantilevered from said wall on which said lower roller is mounted, said housing shell having an upper wall extending horizontally from said upright wall, an electric motor mounted on said upper wall, and a small sheave on said motor and a large sheave on said lower roller and an O-ring connecting said sheaves, and (d) said housing shell including a horizontal base and said upright wall extending upwardly from said base and a removable generally right-rectangular cover fitting over said upright wall and said upper wall and down onto said base, said cover having a top and interengaging means between said top of said cover and the bottom of said base whereby when said cover is removed it can be put on a supporting surface and said base can be supported on said top of said cover so that said rollers can be supported a distance above such supporting surface thereby providing space for collection of yarn passing between said rollers.

7. Means to feed yarn from a skein during knitting periodically operated by a person hand knitting when more yarn is needed for knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers selectively by the knitter for yarn exchange, (b) spring means acting on said rollers to press on said yarn to feed said yarn when said upper roller is in said yarn dispensing position and said rollers are rotated, and means operative to periodically relieve said yarn from roller pressure in periods timed to each rotation of one of said rollers thereby relieving said yarn from twisting to prevent balling, (c) an electric motor connected to one of said rollers to rotate the same and a manually controlled switch controlling operation of said motor whenever the person hand knitting needs a supply of yarn unwound from said skein, (d) said dispenser including a housing shell having an upright wall and a shaft cantilevered from said wall on which said lower roller is mounted, said housing shell having an upper wall extending horizontally from said upright wall, said electric motor being mounted on said upper wall, and a small sheave on said motor and a large sheave on said lower roller and an O-ring connecting said sheaves, (e) said housing shell including a horizontal base and said upright wall extending upwardly from said base and a removable generally right-rectangular cover fitting over said upright wall and said upper wall and down onto said base, said cover having a top and interengaging means between said top of said cover and the bottom of said base whereby when said cover is removed it can be put on a supporting surface and said base can be supported on said top of said cover so that said rollers can be supported a distance above such supporting surface thereby providing space for collection of yarn passing between said rollers, and (f) said support means including a yoke pivotally mounted on said shell to pivot about an axis extending at right angles to said axis of said lower roller and said upper roller being mounted on a shaft cantilevered from the center of said yoke.

8. Means to feed yarn from a skein during knitting periodically operated by a person hand knitting when more yarn is needed for knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers selectively by the knitter for yarn exchange, (b) spring means acting on said rollers to press on said yarn to feed said yarn when said upper roller is in said yarn dispensing position and said rollers are rotated, and means operative to periodically relieve said yarn roller pressure in periods timed to each rotation of one of said rollers thereby relieving said yarn from twisting to prevent balling, (c) an electric motor connected to one of said rollers to rotate the same and a manually controlled switch controlling operation of said motor whenever the person hand knitting needs a supply of yarn unwound from said skein, and (d) said dispenser including a housing shell supporting said rollers, said housing shell including a horizontal base, a removable, generally right-rectangular cover fitting over said housing shell, said covering having a top and interengaging means between said top of said cover and the bottom of said base whereby when said cover is removed it can be put on a supporting surface and said base can be supported on said top of said cover whereby said rollers can be supported a distance above such supporting surface thereby providing space for collection of yarn passing between said rollers.

9. Means to feed yarn from a skein during knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers, (b) said rollers being disposed to press on said yarn to feed said yarn when said upper roller is in said yarn dispensing position and said rollers are rotated, and means operative to periodically relieve said yarn from roller pressure timed to the rotation of said rollers thereby relieving said yarn from twisting to prevent balling (c) said dispenser including a housing shell supporting said rollers, said housing shell including a horizontal base, a removable, generally right-rectangular cover fitting over said housing shell, said cover having a top and interengaging means between said top of said cover and the bottom of said base whereby when said cover is removed it can be put on a supporting surface and said base can be supported on said top of said cover whereby said rollers can be supported a distance above such supporting surface thereby providing space for collection of yarn passing between said rollers, and (d) an electric motor connected to one of said rollers to power the same, a foot-controlled switch and said switch having a cord operative to detachably connect to said motor, said base being removable from said housing shell and having a bottom wall and a partition superposed to one end portion of said bottom wall providing storage room for said switch and cord.

10. Means to feed yarn from a skein during knitting, comprising:

(a) a yarn dispenser supporting a lower and an upper roller, said lower roller being supported to rotate about a substantially horizontal axis, support means supporting said upper roller to move between a yarn releasing position and a yarn dispensing position in which said roller is superposed to said lower roller and supported to rotate about an axis substantially parallel to said axis of said lower roller, said yarn releasing position being removed from said yarn dispensing position by a change in the location of the axis of said upper roller so that yarn can be positioned between said rollers or removed from between said rollers, (b) said rollers being disposed to press on said yarn to feed said yarn when said upper roller is in said yarn dispensing position and said rollers are rotated, and means operative to periodically relieve said yarn from roller pressure timed to the rotation of said rollers thereby relieving said yarn from twisting to prevent balling, (c) said dispenser including a housing shell supporting said rollers, said housing shell including a horizontal base, a removable, generally right-rectangular cover fitting over said housing shell, said cover having a top and interengaging means between said top of said cover and the bottom of said base whereby when said cover is removed it can be put on a supporting surface and said base can be supported on said top of said cover whereby said rollers can be supported a distance above such supporting surface thereby providing space for collection of yarn passing between said rollers, and (d) a case and said dispenser being positioned in said case and said case having a side opening and said rollers being located adjacent to said side opening so that yarn passing between said rollers can exit from said case through said side opening, said interengaging means including a plurality of snap fasteners on said base and depressions on said top of said cover fitting said snap fasteners, and said case having several coacting snap fasteners operative to interengage with said snap fasteners on said base to removably secure said dispenser in position alongside said side opening and permitting removal of said dispenser for use outside said case.

11. Means to feed yarn from a skein during knitting, comprising:

(a) a yarn dispenser having a pair of rollers operative to rotate and to pull said yarn from said skein, (b) a housing shell including a horizontal base and a removable, generally right-rectangular cover fitting over said housing shell and down onto said base, said cover having a top and interengaging means between said top of said cover and the bottom of said base whereby when said cover is removed it can be put on a supporting surface and said base can be supported on said top of said cover whereby said rollers can be supported a distance above such supporting surface thereby providing space for collection of yarn passing between said rollers, and (c) an electric motor connected to one of said rollers to power the same, a foot-controlled switch and said switch having a cord operative to detachably connect to said motor, said base being removable from said housing shell and having a bottom wall and a partition superposed to one end portion of said bottom wall providing storage room for said switch and cord.

12. Means to feed yarn from a skein during knitting, comprising:

(a) a yarn dispenser having a pair of rollers operative to rotate and to pull said yarn from said skein, (b) a housing shell including a horizontal base and a removable, generally right-rectangular cover fitting over said housing shell and down onto said base, said cover having a top and interengaging means between said top of said cover and the bottom of said base whereby when said cover is removed it can be put on a supporting surface and said base can be supported on said top of said cover whereby said rollers can be supported a distance above such supporting surface thereby providing space for collection of yarn passing between said rollers, and (c) a case and said dispenser being positioned in said case and said case having a side opening and said rollers being located adjacent to said side opening so that yarn passing between said rollers can exit from said case through said side opening, said interengaging means including a plurality of snap fasteners on said base and depressions on said top of said cover fitting said snap fasteners, and said case having several coacting snap fasteners operative to interengage with said snap fasteners on said base to removably secure said dispenser in position alongside said side opening and permitting removal of said dispenser for use outside said case.

* * * * *